US006209667B1

(12) United States Patent
Murray et al.

(10) Patent No.: US 6,209,667 B1
(45) Date of Patent: Apr. 3, 2001

(54) DRILL STRING FITTING

(75) Inventors: Geoffrey Neil Murray; Denis Robert Fernandes, both of New Plymouth (NZ)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 08/952,343

(22) PCT Filed: Apr. 26, 1996

(86) PCT No.: PCT/NZ96/00034

§ 371 Date: Feb. 12, 1998

§ 102(e) Date: Feb. 12, 1998

(87) PCT Pub. No.: WO96/34173

PCT Pub. Date: Oct. 31, 1996

(30) Foreign Application Priority Data

Apr. 27, 1995 (NZ) ..... 272003

(51) Int. Cl.[7] ..... E21B 17/10

(52) U.S. Cl. ..... 175/325.3; 175/228; 175/325.5

(58) Field of Search ..... 175/228, 325.2, 175/325.3, 325.5, 325.6

(56) References Cited

U.S. PATENT DOCUMENTS

| | | | | |
|---|---|---|---|---|
| 1,651,088 | | 11/1927 | Fentress . | |
| 1,877,395 | * | 9/1932 | Goeser | 175/325.3 |
| 1,905,158 | | 4/1933 | Craig et al. . | |
| 1,913,365 | * | 6/1933 | Bailey | 175/325.3 |
| 3,410,613 | | 11/1968 | Kuus . | |
| 4,372,622 | * | 2/1983 | Cheek | 175/325.5 |
| 5,485,890 | * | 1/1996 | Cawthorne et al. | 175/228 |
| 5,715,898 | * | 2/1998 | Anderson | 175/325.3 |
| 5,778,976 | * | 7/1998 | Murray | 175/325.5 |

FOREIGN PATENT DOCUMENTS

| | | |
|---|---|---|
| 0 333 450 | 9/1989 | (EP) . |
| 271839 | 3/1928 | (GB) . |
| 2 233 690 | 1/1991 | (GB) . |
| 2 275 284 | 8/1994 | (GB) . |
| WO 95/10685 | 4/1995 | (WO) . |
| WO 95/21986 | 8/1995 | (WO) . |

OTHER PUBLICATIONS

Derwent Abstract Accession No. 559818/30, SU 627230 (Boring Tech Res Ins), Sep. 1978.
Derwent Abstract Accession No. 94–224135/27, SU 1810474 A (Tyumen Ind Inst), Apr. 1993.
Derwent Abstract Accession No. 94–348318/43, SU 1821548 A (UKR Nat Gases Res Inst), Jun. 1993.
Derwent Abstract Accession No. 04193 K/02, SU 911007 A (Bashkir Petroind), Mar. 1982.
Derwent Abstract Accession No. 84–286695/46, SU 1016475 A (Parkhomenko V F), May 1983.
Derwent Abstract Accession No. 71801E/34, SU 874947 A (Sakhalin Fas Ind), Oct. 1981.

* cited by examiner

*Primary Examiner*—William Neuder
(74) *Attorney, Agent, or Firm*—Fulbright & Jaworski L.L.P.

(57) ABSTRACT

A fitting for reducing friction between a drilling string and the wall of a well. In a first aspect the fitting has recesses (6) provided along the bore of the fitting to lubricate the interface between the fitting and the drill string to minimise friction. In a second aspect a fitting is provided on a drill string having rotatable roller means (21) which can rotate about a point of rotation (23) so as to minimise both axial and rotational friction. According to a third aspect the fitting comprises an inner section (30) secured to a drill pipe (35) or other fitting and an outer section (31) rotatable about the inner section (30). Preferably a sealed bearing (36, 42–47, 37, 38) is provided between the inner section (30) and outer section (31).

41 Claims, 6 Drawing Sheets

DRILL STRING FITTING

TECHNICAL FIELD

The present invention relates to a fitting for reducing friction between a drill string and the wall of a well. More particularly, but not exclusively, in a first aspect the present invention relates to a fitting having a plurality of longitudinal recesses enabling lubrication between the fitting and a drill string using drilling fluid. According to a second aspect there is provided a fitting having rotatable rollers to reduce both axial and rotational friction. According to a third aspect there is provided a fitting having an outer section rotatable relative to an inner section secured about a drill string.

BACKGROUND OF THE INVENTION

The depth to which and angle at which a well can be drilled are often limited by the degree of friction experienced by the drill string. The life of a drill string may also be reduced due to friction. With increasing environmental concerns it is also becoming less acceptable to reduce friction by injecting chemicals down a well. Using well-stream fluids as a lubricant results in drill string wear due to particulate matter carried in the fluids. Further, currently available similar fittings cannot be rebuilt or reconditioned.

DISCLOSURE OF THE INVENTION

It is an object of the present invention to provide a fitting which reduces the friction on a drill string or at least to provide the public with a useful choice.

According to a first aspect of the invention there is provided a fitting for reducing friction between a fitting and a section of a drill string or further fitting on a drill string, said fitting comprising a body having a tubular bore provided with a plurality of longitudinally extending recesses spaced circumferentially about the bore, dimensioned to lubricate the interface between the fitting and the drill string or further fitting with fluid in a drilling well, wherein rollers are provided about the periphery of the body to reduce friction in the axial direction.

Preferably the bore of the fitting has a polygonal cross-section. In another embodiment the fittings may have a substantially circular cross-section and the sleeve may have a polygonal cross-section. The fitting may preferably be formed as a two part casing which can be secured to an assembled drill string.

According to a further aspect of the invention there is provided a fitting for engagement to a drill string or further fitting having a body with a bore therethrough provided with a plurality of roller means on the exterior of the body, each said roller means having one or more roller provided thereon and being rotatable relative to the body about an axis transverse to the axis of the bore, the arrangement being such that the roller means can rotate relative to said body to facilitate reduction of rotational and axial friction.

Preferably, the rollers have a substantially tapered cylindrical form and rotate about an axis transverse to the axis of rotation of the roller means. The body may be of two part construction and the rollers are preferably formed of a nylon or ceramic material.

According to a further aspect of the invention there is provided a fitting for engagement with a drill string or further fitting comprising an inner section for securement to a drill string or further fitting, an outer section for securement about said inner section, a bearing located between the inner section and outer section, seals provided at either end of the fitting between the inner section and outer section and pressure compensating means for maintaining the pressure within the bearing substantially the same as the external pressure.

Preferably a plurality of fins project radially from the outer section which are profiled to reduce drag in the axial direction.

BRIEF DESCRIPTION OF THE DRAWINGS

Further aspects of the invention will become apparent from the following description which is given by way of example of possible embodiments with reference to the accompanying drawings in which.

BEST MODE FOR CARRYING OUT THE INVENTION

Figure 1:
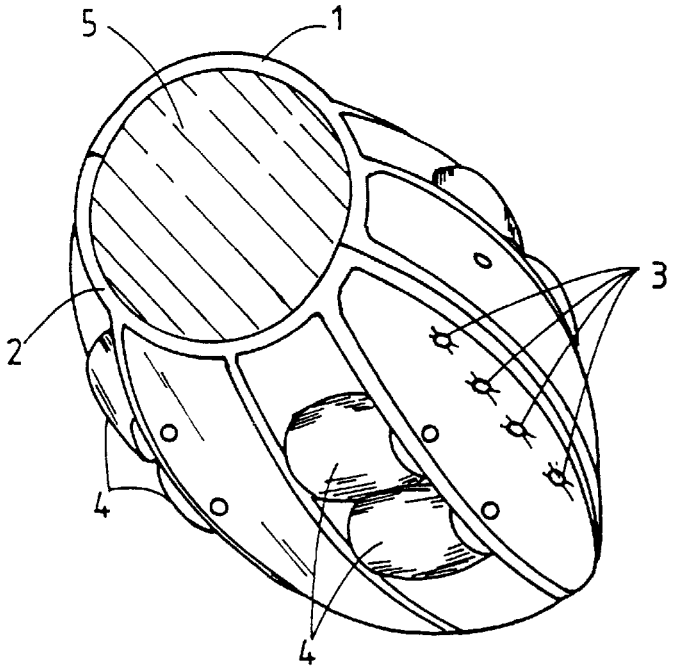
FIG. 1: Shows a two part fitting having a polygonal bore.
Figure 2:
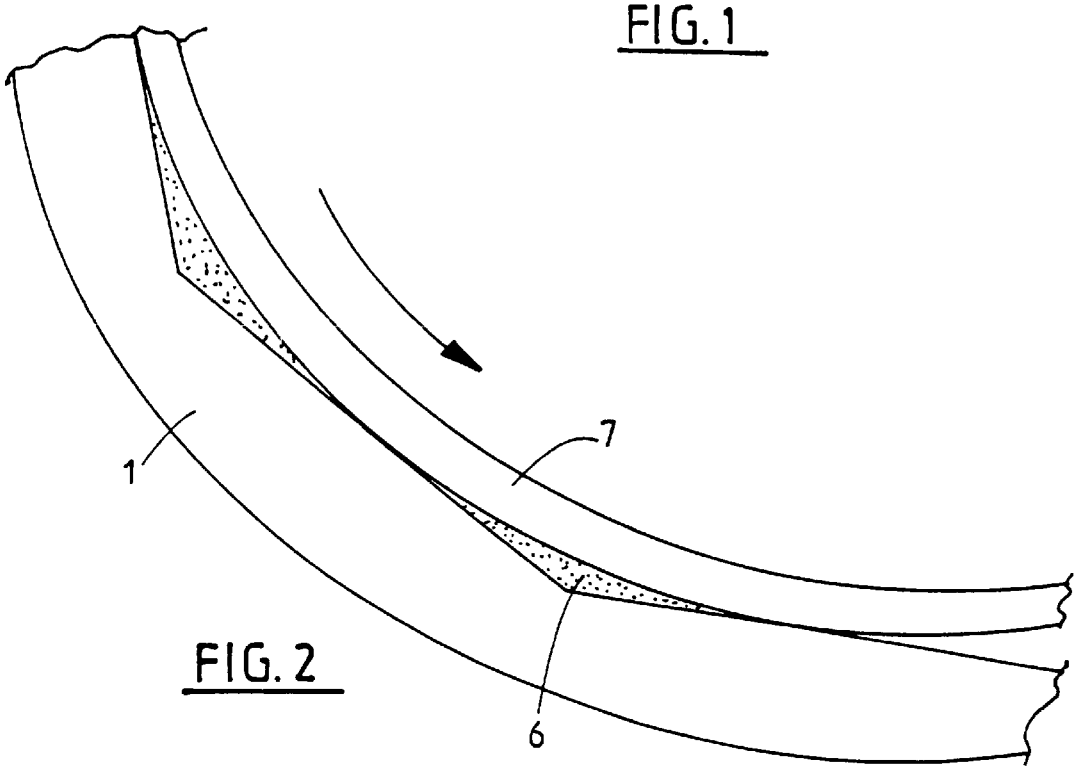
FIG. 2: Shows the interface between a drill string and the interior polygonal bore of the fitting shown in FIG. 1.

Referring firstly to FIGS. 1 to 6, there is shown a fitting for reducing friction on a pipe string. The fitting comprises a body formed of two parts 1 and 2 which may be secured together by bolts which pass through apertures 3. A plurality of rollers 4 are provided about the outside of the fitting to reduce longitudinal friction on the pipe string. The bore 5 of the body sections is polygonal so as to provide a number of longitudinal recesses 6 between the body 1 and a sleeve 7.

Figure 3:
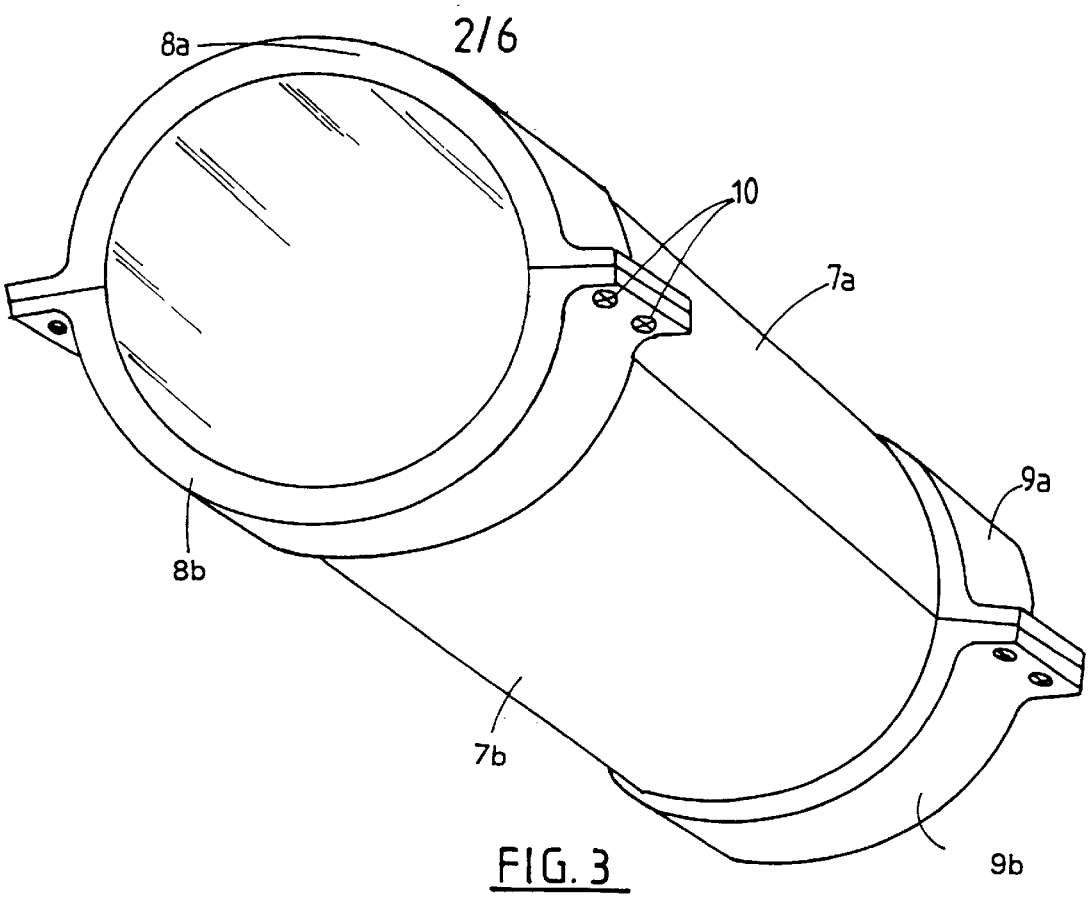
FIG. 3: Shows a section of drill string having collars at either end for receiving the fitting of FIG. 1 therebetween.
Figure 4:
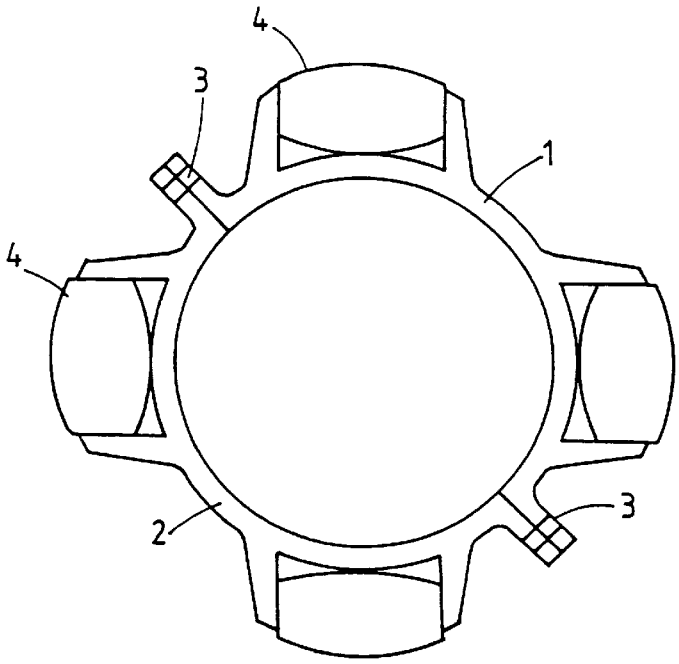
FIG. 4: Shows an end view of the fitting of FIG. 1.

Drilling pipe is usually forged from high tensile steel. The outside surface is typically rough. The preferred method of securing the fitting of the invention to a drilling pipe is as follows. Firstly, a section of the drilling pipe is machined so as to have a relatively smooth outside surface. The two halves 7*a* and 7*b* of the sleeve shown in FIG. 3 are then secured to the drilling pipe by bolts etc passing through the apertures of collars 8*a*, 8*b*, 9*a* and 9*b*. Once the sleeve has been secured to a section of pipe, the two halves 1 and 2 of the fitting are secured about sleeve portions 7*a* and 7*b* and secured by bolts passing through apertures 3.

Collars 8 and 9 restrict the longitudinal movement of the fitting. The fitting is however free to rotate about sleeve 7. Accordingly, friction due to rotation of the drilling rig is minimised due to the fluid lubricant provided in recesses 6 between body sections 1 and 2 and sleeve 7. Axial friction is reduced by rollers 4 which minimise friction between the wall of the well and the fitting in the longitudinal direction.

It would be possible to secure the fitting directly about a section of pipe. This would however not reduce friction to the same extent as by providing smooth sleeve 7. Where a new section of pipe is being manufactured, it may of course be provided with a smooth section having separate collars 8 and 9 integrally formed at either end thereof for receiving the fitting.

Although the interior bore 5 of the fitting has been described as polygonal, it will be appreciated that other shapes of internal bore (eg: sinusoidal) may be provided as long as suitable recesses are provided between the sleeves and the body of the fitting to minimise friction. In some applications the bore 5 of the fitting may be spiralled to minimise the effect of transitions from one recess to another and to promote fluid flow through the fitting. Filtering means, such as wire mesh may preferably be provided at either end of the fitting to prevent large debris entering the recesses.

Figure 5:
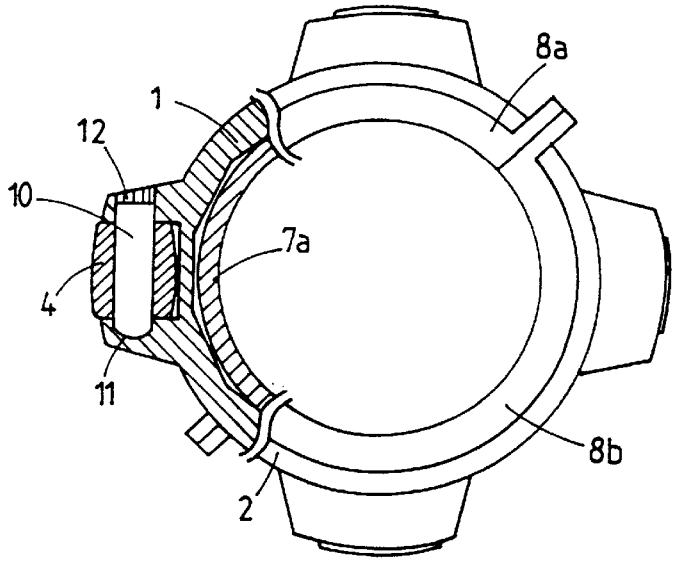
FIG. 5: Shows an end view of the fitting of FIG. 1 engaged with the sleeve shown in FIG. 3.

In viewing FIG. 5 it will be seen that each roller 4 is secured to body 1 by a pin 10 passing through roller 4. Pin 10 may pass through aperture 12 in body 1 into recess 11. The aperture 12 may then be welded closed to prevent the pin 10 be removed.

Roller 4 may preferably be formed of a ceramic or nylon material. Ceramic materials have the advantage that they exhibit excellent wear properties and have a low friction coefficient. Newly developed ceramics have acceptable "ductility" properties and are easily formed. Ceramics are also very stable at high temperatures and are self lubricating, so do not require oil-based lubrication. Ceramics materials are not susceptible to Theological failure or welding either. One of the key advantages, however, is that the density of ceramic materials is such that if a roller breaks the pieces can be circulated out of the well bore, unlike steel fragments which sink to the bottom of the well and interfere with drilling.

Figure 6:
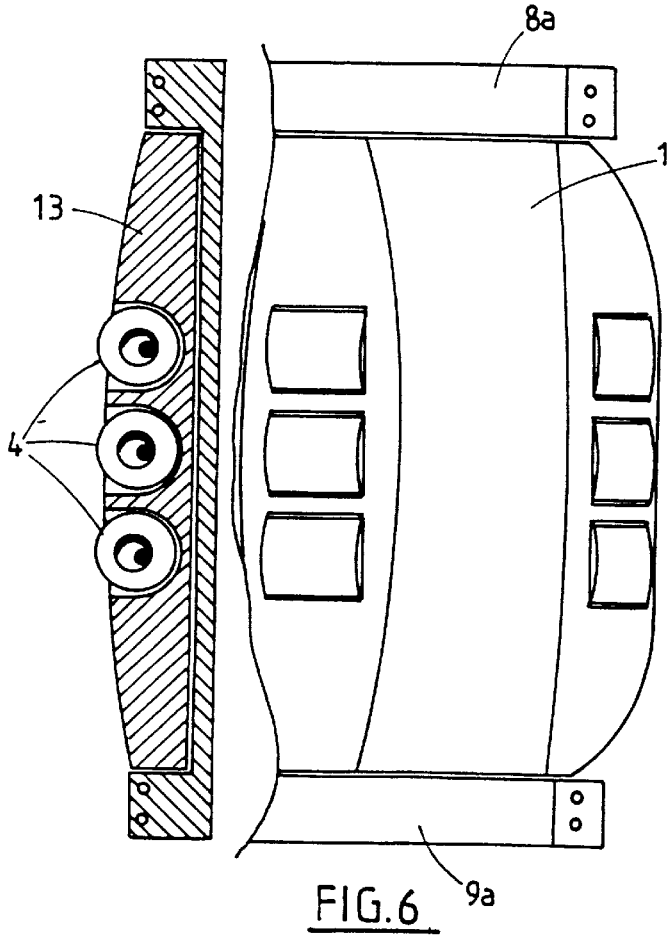
FIG. 6: Shows a front view of the fitting of FIG. 1 showing a partial cross-sectional view.

As shown in FIG. 6 a protective section 13 may be provided between the collars 8*a*, 8*b* and 9*a*, 9*b* and between the rollers 4 to create a smooth exterior profile so that parts of the fitting do not catch as the fitting is moved up and down in a well.

It is estimated that using fittings as herein before described about drill pipe joints will reduce the drag by at least 30%. This enables wells to be drilled to greater displacements and at higher angles. Further, expensive drill pipe is protected and the fitting is exposed to most of the wear. The fitting is designed for easy retrofitting to existing pipe and so avoids the need for large expenditure on new pipe strings.

Figure 7:
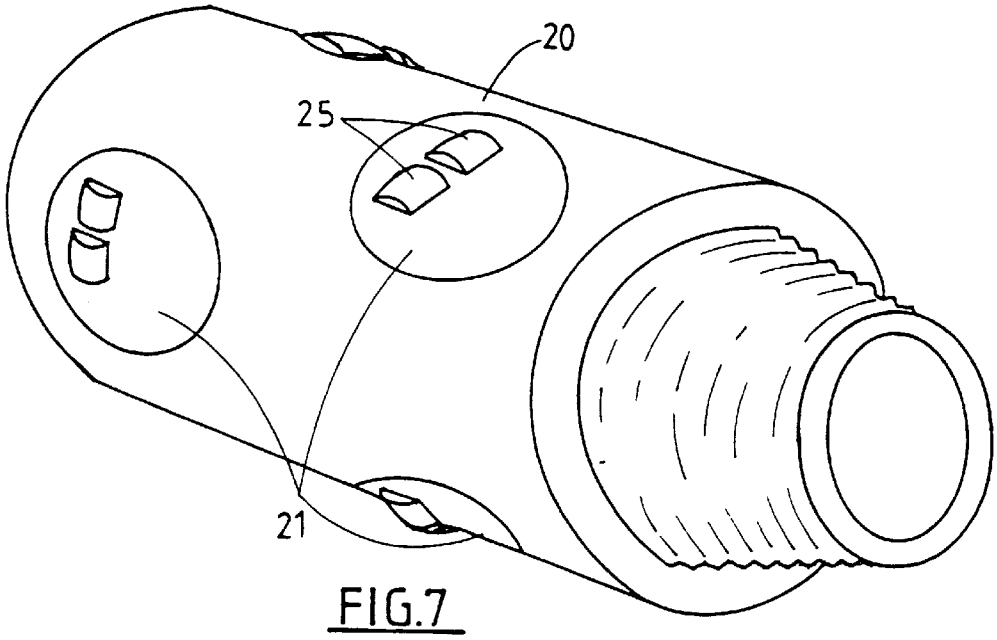
FIG. 7: Shows a fitting having rotatable rollers provided on the body thereof.
Figure 8:
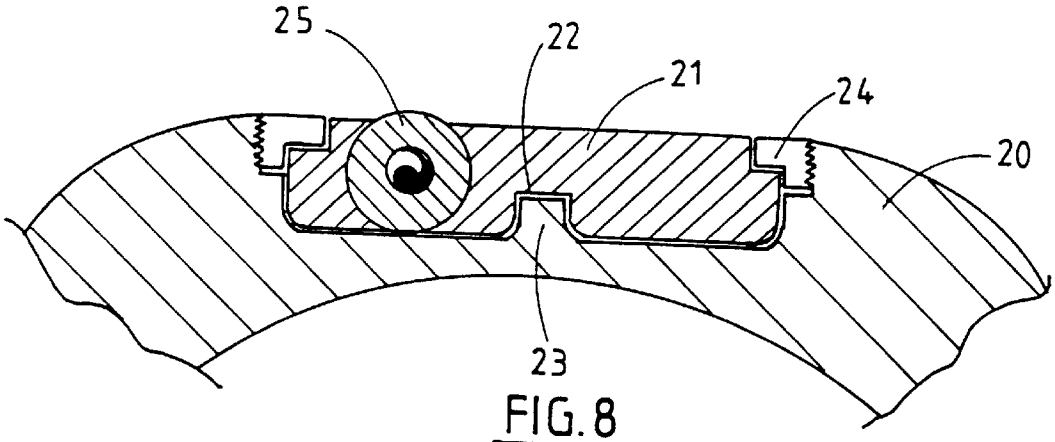
FIG. 8: Shows a cross-sectional view of a rotatable roller shown in FIG. 7.
Figure 9:
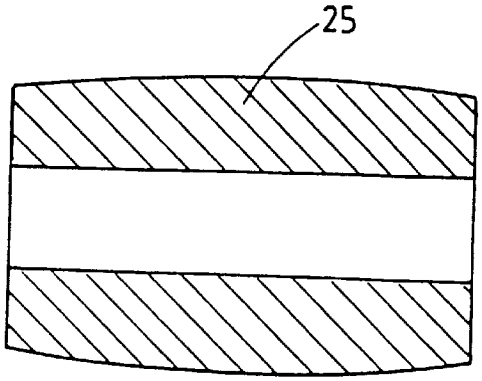
FIG. 9: Shows a cross-sectional view of a roller of a rotatable roller shown in FIG. 7 or FIG. 8.

FIGS. 7 to 9 show a second embodiment of the invention. The aim again is to reduce longitudinal and rotational friction on a pipe string or fittings employed therewith. A simple one part construction is described although it will be appreciated that a two part body as previously described, may be employed.

Body 20 is provided with a plurality of rotatable roller means 21, shown in more detail in FIG. 8. Rotatable roller means 21 are substantially disc-shaped and have a cylindrical recess 22 located at the centre thereof. Pin 23 of body 20 engages in recess 22 so that the rotatable roller means 21 is rotatable about pin 23. Circumferential flange 24 is secured after roller means 21 has been inserted and retains the roller means 21 in place in use. Circumferential flange 24 may be secured firmly in place by welding etc. The rotatable rollers 25 are secured off-centre from pin 23 so that the rotatable roller means 21 may be rotated as it is exposed to different types of frictional force (i.e. longitudinal or rotational).

From the above it will be apparent that when body 20 experiences pure rotation relative to the wall of a well, rollers 25 will not be able to rotate (in the position shown in FIG. 7) and will cause the rotatable roller means 21 to rotate 90° so that the axes of the rollers are aligned with the axis of the drilling rig. When in this position, the rollers can freely rotate to minimise friction. When the drill string is moved purely in the longitudinal direction, the rollers will stay in the position as shown in FIG. 7 so that they may freely rotate to reduce longitudinal friction. It will be appreciated that when there is a combination of rotational and axial movement the axis of the rollers will be somewhere between the two positions described above.

Figure 10:
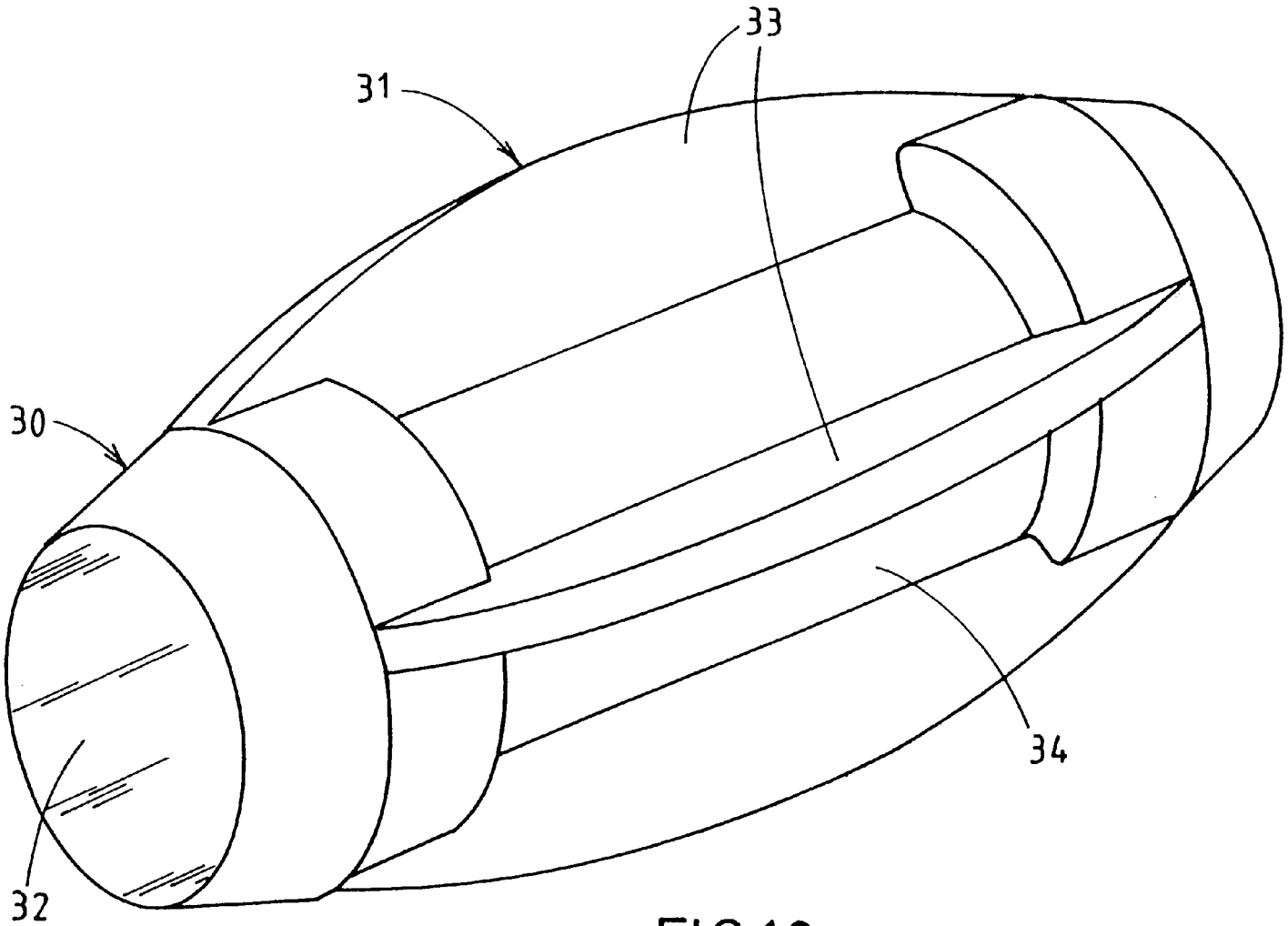
FIG. 10: Shows a perspective view of a fitting according to a third embodiment.
Figure 11:
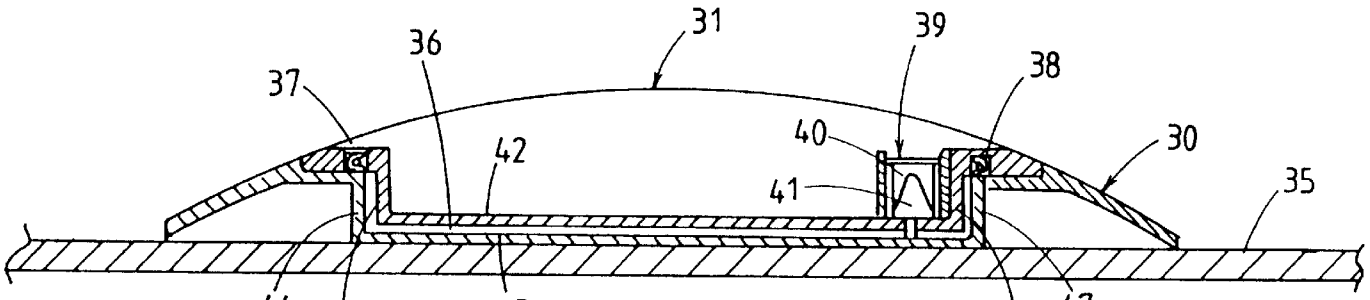
FIG. 11: Shows a cross-sectional view along the axis of the fitting shown in FIG. 10.
Figure 12:
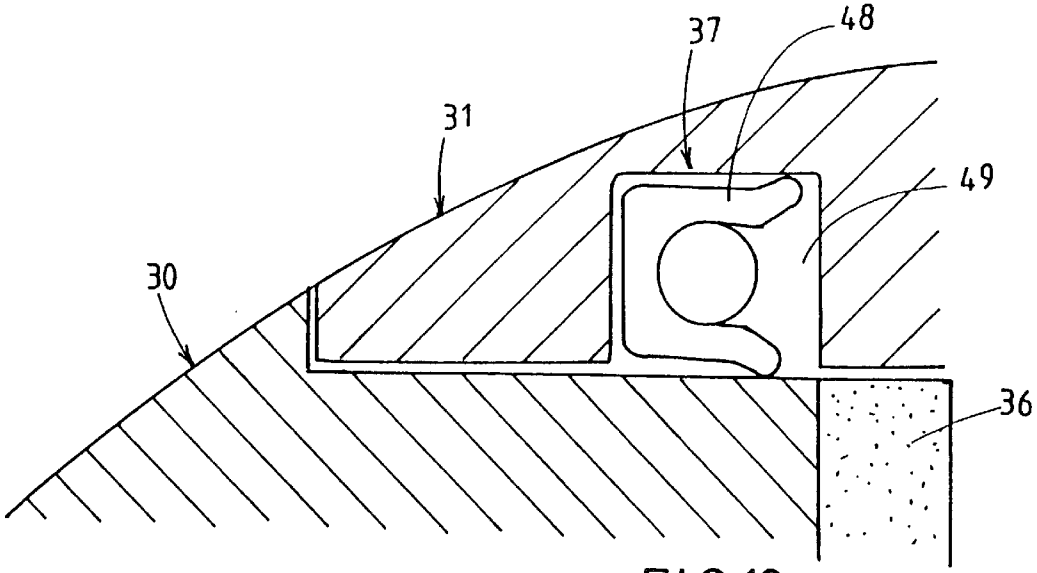
FIG. 12: Shows an enlarged view of the seal arrangement shown in FIG. 11.

Referring to FIGS. 10 to 12 a third embodiment will be described. The fitting of the third embodiment comprises an inner section 30 and an outer section 31 which is rotatable about inner section 30. Inner section 30 is adapted to be secured about a drill pipe which passes through bore 32. Inner section 30 may be of two part construction (similar to that shown in FIG. 3) where the two parts are secured together by bolts or similar fastening means. Outer section 31 may similarly be of two part construction and be secured about inner section 30. Outer section 31 is provided with a plurality of fins 33 extending radially from body 34.

FIG. 11 shows a cross-sectional view along the axis of the fitting shown in FIG. 10. In this case the fitting is secured to a drill pipe 35. A layer of friction reducing material 36 is provided between faces 42 to 47 to reduce friction as outer section 31 rotates about inner section 30. Layer 36 will preferably be formed of a plastics material such as nylon (zytel 70633L for example).

Seals 37 and 38 are provided at either end of the bearing formed by the inter-engaging faces 42 to 47 of inner section 30 and outer section 31 and friction reducing layer 36. These seals serve to prevent the ingress of fluid from a well into the bearing. This greatly reduces friction on bearing surfaces, thus reducing wear and decreasing the torque required to drive a drill string.

Due to the sealed nature of the bearing a pressure compensating system 39 is provided to compensate the pressure within the bearing as the external pressure varies. The pressure compensating system comprises a diaphragm 40 containing grease within region 41 which moves in and out of the bearing as external pressure varies. This prevents external fluid being drawn into the bearing as the external pressure increases.

The bearing journals 42 and 43 are preferably precision ground. Bearing sleeves may be provided if required. Sections 44 and 45, and 46 and 47 of the bearing minimise friction when the outer section 31 is forced in the axial direction relative to the inner section 30.

Referring now to FIG. 12, seal 37 is shown in detail. The seal is seen to include a resilient seal 48 located within a recess 49 in outer section 31. Seal 48 is preferably formed of a fibre reinforced PTFE.

The profile of the fins 33 is shown to be semi-circular in FIGS. 10 and 11. It is to be appreciated that other profiles may be employed which reduce drag in the axial direction. The curved profile shown is preferred due to its drag reduction in both directions. It is to be appreciated that rollers could be provided upon fins 31 to assist in the reduction of axial drag. The fins are preferably coated with a ceramic coating such as CERAM-KOTE™.

Bearing surfaces 42 to 47 are preferably coated with a hard material such as Technogenia "technopoudre" or similar. Channels are preferably provided in bearing surfaces 42 and 43 to facilitate the flow of lubricant. These channels will preferably be semicircular in profile and will preferably spiral along the length of the journals (similar to the recesses 6 shown in FIG. 2).

This fitting may be mounted directly onto a drill pipe during production or may be retrofitted to an existing drill pipe. Alternatively, the fitting may be provided on its own separate "sub" or mandrill, in which case the "sub" or mandrill may be screwed into the drill string between two lengths of drill pipe.

It will thus be seen that the invention provides a number of simple inexpensive fittings for reducing the friction experienced between a drill string and the wall of a well. The fittings may be used to protect the joints of pipe strings or fitting tools as required. The invention reduces friction and thus the required torque to drill a well. Reduction of friction also reduces drill string vibration and thus fatigue in the drill string. The invention also minimises environmental damage by using a water-based mud lubricant.

Where in the foregoing description reference has been made to integers or components having known equivalents then such equivalents are herein incorporated as if individually set forth.

Although this invention has been described by way of example and with reference to possible embodiments thereof, it is to be appreciated that improvements and/or modifications may be made thereto without departing from the scope of the invention as defined in the claims.

Industrial applicability

The present invention may find particular application in the reduction of friction experienced by drilling strings.

What is claimed is:

1. A fitting apparatus securable to a section of a drill string or a second fitting on said drill string, said fitting apparatus comprising: a body having a tubular bore, said tubular bore provided with a plurality of longitudinally extending recesses spaced circumferentially about the bore, said recesses dimensioned to receive a lubricating fluid for substantially reducing rotational friction between said fitting apparatus and said drill string, or between said fitting apparatus and said second fitting on said drill string;

and rollers provided about the periphery of the body to reduce friction in the axial direction.

2. A fitting apparatus as claimed in claim 1 wherein the bore of the fitting apparatus is polygonal in cross-section.

3. A fitting apparatus as claimed in claim 1 wherein the recesses spiral along the length of the bore.

4. A fitting apparatus as claimed in claim 1 wherein said rollers are provided in banks about the circumference of the body.

5. A fitting apparatus as claimed in claim 4 wherein each said bank of rollers includes a protective mounting assembly which exposes only a portion of each said roller.

6. A fitting apparatus as claimed in claim 1 wherein the fitting apparatus is of two part construction adapted to be secured about said drill string.

7. A fitting apparatus as claimed in claim 1 wherein a filtering means is provided at either end of the fitting apparatus to prevent debris entering the longitudinal recesses.

8. A fitting apparatus as claimed in claim 1 said fitting apparatus being adapted to engage said second fitting, wherein said second fitting is a sleeve having collars at either end adapted to be secured to a section of said drill string with the fitting apparatus secured thereabout between said collars.

9. A fitting apparatus as claimed in claim 1 having a bore of substantially circular cross-section in combination with said second fitting for securement to a section of drill pipe wherein said second fitting has a substantially polygonal cross-section.

10. A fitting apparatus for engagement to a drill string or a second fitting on said drill string, said fitting apparatus comprising: a body with a bore therethrough, wherein said bore is polygonal in cross-section, and a plurality of roller means on the exterior of the body, each said roller means having one or more rollers provided thereon and being rotatable relative to the body about an axis transverse to the axis of the bore, the arrangement being such that the roller means can rotate relative to said body to facilitate reduction of rotational axle friction.

11. A fitting apparatus as claimed in claim 10 wherein the rollers includes rollers positioned away from the transverse axis so as to rotate said roller means to keep the axis of said rollers substantially transversed to the direction of movement.

12. A fitting apparatus as claimed in claim 11 wherein a plurality of rollers are provided on each said roller means.

13. A fitting apparatus as claimed in claim 10 wherein the roller means comprises a substantially disc-shaped member located within a corresponding recess in the body.

14. A fitting apparatus as claimed in claim 13 wherein said disc-shaped member includes a central bore which locates with a pin extending outwardly from said body.

15. A fitting apparatus as claimed in claim 13 wherein a plate is secured above the peripheral edge of each roller means to retain it within its recess.

16. A fitting apparatus as claimed in claim 10 wherein the rollers are formed of a nylon or ceramic material.

17. A fitting apparatus as claimed in claim 10 wherein the rollers have a substantially tapered cylindrical form and rotate about an axis transverse to the axis of rotation of the roller means.

18. A fitting apparatus as claimed in claim 10 wherein the body is of two part construction so that it may be secured about a section of said drill string.

19. A fitting apparatus for engagement with a drill string or second fitting on the drill string, said fitting apparatus comprising: an inner section for securement to the drill string or second fitting, an outer section for securement about said inner section and rotatable relative thereto, a bearing comprising a layer of friction reducing material and located between said inner section and said outer section, seals provided at either end of said fitting apparatus between said inner section and said outer section and pressure compensating means for maintaining the pressure within the bearing substantially the same as external pressure.

20. A fitting apparatus as claimed in claim 19 wherein the layer of friction reducing material is formed of a plastics material.

21. A fitting apparatus as claimed in claim 20 wherein the plastics material is nylon.

22. A fitting as claimed in claim 19 wherein the bearing comprises first journal surfaces on said inner and outer sections in the axial direction of said fitting apparatus and second and third journal surfaces on said inner and outer sections extending radially outwards to restrict movement of said outer section relative to said inner section in the axial direction.

23. A fitting apparatus as claimed in claim 19 wherein a plurality of fins project radially from said outer section which are profiled to reduce drag in the axial direction.

24. A fitting apparatus as claimed in claim 23 wherein the fins have a curved profile.

25. A fitting apparatus as claimed in claim 19 wherein rollers are provided on the periphery of said outer section to reduce friction in the axial direction.

26. A fitting apparatus securable to a section of a drill string or a second fitting on said drill string, said fitting apparatus comprising: a body having a tubular bore, said tubular bore provided with a plurality of longitudinally extending recesses spaced circumferentially about the bore, said recesses dimensioned to receive a lubricating fluid for substantially reducing rotational friction between said fitting apparatus and said drill string, or between said fitting apparatus and the second fitting on said drill string, wherein said tubular bore is polygonal in cross-section; and, rollers provided about the periphery of the body to reduce friction in the axial direction.

27. A fitting apparatus as claimed in claim 26, wherein the recesses spiral along the length of the bore.

28. A fitting apparatus as claimed in claim 26, wherein said rollers are provided in banks about the circumference of the body.

29. A fitting apparatus as claimed in claim 28, wherein each said bank of rollers includes a protective mounting assembly which exposes only a portion of each of said rollers.

30. A fitting apparatus as claimed in claim 26, wherein said fitting apparatus is of two part construction, said fitting apparatus being adapted to be secured about said drill string.

31. A fitting apparatus as claimed in claim 26, further comprising:

a first filter and a second filter, said filters being located at a first and second end of said fitting apparatus respectively, to prevent debris from entering said longitudinal recesses.

32. A fitting apparatus as claimed in claim 26, wherein said fitting apparatus is configured to be engageable with a second fitting that is a sleeve having collars at either end secured to a section of the drill string, said fitting apparatus being securable between the collars.

33. A fitting apparatus as claimed in claim 26, said fitting apparatus having a tubular bore of substantially circular cross-section in combination with said second fitting for securement to a section of drill pipe wherein said second fitting is substantially polygonal in cross-section.

34. A fitting apparatus for engagement with a drill string or second fitting on said drill string, said fitting apparatus comprising: an inner section for securement to said drill string or said second fitting, an outer section for securement about said inner section and rotatable relative thereto, a bearing located between said inner section and said outer section, wherein said bearing comprises a layer of friction reducing material; seals provided at either end of said fitting apparatus between said inner section and said outer section; and, a pressure compensator located between said bearing and the exterior of said fitting apparatus, said pressure compensator adapted to maintain the pressure within said bearing substantially the same as external pressure.

35. A fitting apparatus as claimed in claim 34, wherein the layer of friction reducing material is formed of a plastics material.

36. A fitting apparatus as claimed in claim 35, wherein the plastics material is nylon.

37. A fitting apparatus as claimed in claim 34, wherein the bearing is filled with a lubricating fluid.

38. A fitting as claimed in claim 34, wherein the bearing comprises first journal surfaces on said inner and outer sections in the axial direction of said fitting apparatus and second and third journal surfaces on said inner and outer sections extending radially outwards to restrict movement of said outer section relative to said inner section in the axial direction.

39. A fitting apparatus as claimed in claim 34, wherein a plurality of fins project radially from said outer section which are profiled to reduce drag in the axial direction.

40. A fitting apparatus as claimed in claim 39, wherein the fins have a curved profile.

41. A fitting apparatus as claimed in claim 34, said fitting apparatus further comprising rollers on the periphery of said outer section to reduce friction in the axial direction.

* * * * *